US007736036B2

(12) United States Patent
Tatsukawa

(10) Patent No.: US 7,736,036 B2
(45) Date of Patent: Jun. 15, 2010

(54) LAMP UNIT OF VEHICLE HEADLAMP

(75) Inventor: Masashi Tatsukawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 145 days.

(21) Appl. No.: 11/723,109

(22) Filed: Mar. 16, 2007

(65) Prior Publication Data

US 2007/0230204 A1 Oct. 4, 2007

(30) Foreign Application Priority Data

Mar. 29, 2006 (JP) ..... 2006-090903

(51) Int. Cl.
*F21V 5/00* (2006.01)

(52) U.S. Cl. ..... 362/522; 362/507; 359/726

(58) Field of Classification Search ..... 362/507, 362/509, 521, 522, 538, 545; 359/726, 738
See application file for complete search history.

(56) References Cited

U.S. PATENT DOCUMENTS

| | | | | |
|---|---|---|---|---|
| 1,659,508 | A * | 2/1928 | Allan | 362/509 |
| 2,782,297 | A * | 2/1957 | Kirk, Jr. et al. | 362/309 |
| 4,577,260 | A * | 3/1986 | Tysoe | 362/521 |
| 4,796,171 | A | 1/1989 | Lindae et al. | |
| 6,416,210 | B1 | 7/2002 | Uchida | |
| 6,948,836 | B2 * | 9/2005 | Ishida et al. | 362/516 |

FOREIGN PATENT DOCUMENTS

| | | | |
|---|---|---|---|
| DE | 3430179 | A1 | 3/1985 |
| DE | 3602262 | C2 | 5/1987 |
| DE | 4031352 | A1 | 4/1992 |
| JP | 62-113301 | A | 5/1987 |
| JP | 01-0186701 | A | 7/1989 |
| JP | 03-122902 | A | 5/1991 |
| JP | 2001-23419 | A | 1/2001 |
| JP | 2005-302718 | A | 10/2005 |

OTHER PUBLICATIONS

German Office Action dated May 22, 2009.
Notice of Reasons of Rejection issued in counterpart Japanese Application No. 2006-090903 dated Feb. 9, 2010.

* cited by examiner

*Primary Examiner*—Jong-Suk (James) Lee
*Assistant Examiner*—Julie A Shallenberger
(74) *Attorney, Agent, or Firm*—Sughrue Mion, PLLC

(57) ABSTRACT

An upper portion region and a lower portion region at a front side surface of a projector lens are constituted as up and down direction diverging portions provided with a plurality of lens elements extended substantially in a horizontal direction by a vertical sectional shape formed in a recessed and projected shape relative to a reference face of the front side surface. After diverging light emitted from the upper portion region and the lower portion region to a front side in an up and down direction, a diverging degree thereof is made to be able to be controlled accurately to thereby pertinently shade off the cutoff line. A spectroscopic color appearing at an upper vicinity of the cutoff line owing to a spectroscopic light phenomenon brought about when light reflected from a reflector transmits through the projector lens is made to be inconspicuous.

11 Claims, 7 Drawing Sheets

LAMP UNIT OF VEHICLE HEADLAMP

This application claims foreign priority from Japanese Patent Application No. 2006-090903, filed on Mar. 29, 2006, the entire contents of which are hereby incorporated by reference.

BACKGROUND OF THE INVENTION

1. Field of the Invention

The present invention relates to a lamp unit of a vehicle headlamp, particularly relates to a lamp unit of a projector type constituted to form a light distribution pattern having a cutoff line.

2. Related Art

In a background art, a lamp unit of a projector type is known as a lamp unit of a vehicle headlamp. The lamp unit of the projector type is constructed by a constitution including a projector lens arranged on an optical axis extended in a front and rear direction of a vehicle, a light source arranged on a rear side of a rear side focal point of the projector lens, and a reflector for reflecting light from the light source to a front side to be proximate to the optical axis. When a light distribution pattern having a cutoff line as in a light distribution pattern for low beam is formed by light irradiated from the projector type lamp unit, there is constructed a constitution of arranging a shade for shielding a portion of reflected light from the reflector at a position of the rear side focal point of the projector lens and a cutoff line is formed as an inverted projected image of an upper end edge thereof.

At that occasion, JP-A-03-122902 discloses a lamp unit of a projector type in which a surface of a projector lens is constituted by a small recessed and projected face. JP-A-2005-302718 discloses a lamp unit of a projector type in which a plurality of recessed and projected portions are formed on a surface of a projector lens thereof in a shape of concentric circles. JP-A-01-186701 discloses a lamp unit of a projector type in which an upper portion region and a lower portion region remote from an optical axis in an up and down direction are constituted to deflect light emitted from a projector lens in a lower direction at a surface of the projector lens.

When the light distribution pattern having the cutoff line is formed by light irradiated from the lamp unit of the projector type, the cutoff line is formed extremely clearly as the inverted projected image of an upper end edge of the shade. Therefore, light is hardly irradiated to an upper side of the cutoff line, and optical recognizability of a remote region of a vehicle front side road face is liable to be insufficient. In such a case, there is a concern of giving a useless strange feeling to a driver of a vehicle running on an opposed lane, since a spectroscopic color appears at a vicinity of an upper side of the cutoff lien by a spectroscopic phenomenon brought about when light from a light source reflected by the reflector transmits through the projector lens.

In contrast thereto, when the constitutions described in JP-A-03-122902 and JP-A-2005-302718 are adopted, the cutoff line can be shaded off by diverging light emitted from the projector lens, thereby, the spectroscopic color at an upper vicinity of the cutoff line can be made inconspicuous.

However, according to the projector lens described in JP-A-03-122902, since the surface is constituted by the small recessed and projected face, it is not easy to control a degree of diverging light emitted from the projector lens, the diverging is liable to be insufficient or excessive. There poses a problem that when the diverging is insufficient, the cutoff line is sufficiently shaded off or a countermeasure against the spectroscopic color at an upper vicinity thereof becomes insufficient. On the other hand, when the diverging is excessive, by diverging light by which a lower vicinity region of the cutoff line is to be formed, a brightness thereof is reduced, glare is liable to be cast to a driver running on an opposed lane since light diverged to an upper side of the cutoff line becomes excessively large.

According to the projector lens described in JP-A-2005-302718, since the surface is formed with a plurality of recessed and projected portions in the shape of concentric circles, a degree of diverging light emitted from the projector lens can accurately be controlled. However, the emitted light is diverged in a diameter direction relative to the optical axis of the projector lens. Therefore, there poses a problem that there is brought about variations in shading off the cutoff line or an effect of the counter measure against the spectroscopic color at the upper vicinity are brought about depending on a position from which light from the projector lens is emitted.

According to the projector lens described in JP-A-01-186701, the upper region and the lower region of the surface remote from the optical axis in the up and down direction are constituted to deflect light emitted from the projector lens in the lower direction. Therefore, light emitted from the region of increasing a spectroscopic degree can be concealed to a position on the lower side of the cutoff line. Thereby, the effect of the countermeasure against the spectroscopic color can be promoted. However, when constituted in this way, a clearness of the cutoff line is further promoted. Therefore, there poses a problem that with regard to the effect of shading off the cutoff line, an inverse effect is rather brought about.

SUMMARY OF THE INVENTION

The invention has been carried out in view of such a situation and it is an object thereof to provide a lamp unit of a vehicle headlamp capable of promoting to shade off a cutoff line and an effect of a countermeasure against a spectroscopic color at an upper vicinity thereof in a lamp unit of a vehicle headlamp of a projector type constituted to form a light distribution pattern having a cutoff line.

The invention achieves the above-described object by devising a shape of a surface of a projector lens in addition to providing a light diverging function to the surface of the projector lens.

In accordance with one or more embodiments of the present invention, a lamp unit of a vehicle headlamp is provided with a projector lens arranged on an optical axis extended in a front and rear direction of a vehicle, a light source arranged on a rear side of a rear side focal point of the projector lens, a reflector for reflecting light from the light source in a front direction to be proximate to the optical axis, and a shade arranged such that an upper end edge thereof passes the rear side focal point of the projector lens to shield a portion of light reflected from the reflector for forming a light distribution pattern having a cutoff line as an inverted projected image of the upper end edge of the shade. In the lamp unit, at least a portion of a surface of the projector lens is constituted as an up and down direction diverging portion comprising a plurality of lens elements extended substantially in a horizontal direction by a vertical sectional shape formed in a recessed and projected shape relative to a reference face of the surface.

The "light distribution pattern having a cutoff line" may be a light distribution pattern for low beam or may be a light distribution pattern constituting a portion thereof.

A kind of the "light source" is not particularly limited but, for example, a light emitting portion of a discharge bulb or a halogen bulb, or a light emitting chip of a light emitting element of a light emitting diode or the like can be adopted.

The "light source" may be arranged on the optical axis or may be arranged at a position deviated from the optical axis so far as the "light source" is arranged on the rear side of the rear side focal point of the projector lens.

The "projector lens" is not limited to a lens of a specific shape so far as the "projector lens" is a lens having a positive refracting power, for example, a flat concave lens, a both concave lens, a concave meniscus lens or the like can be adopted.

The "surface" of the projector lens may be a front side surface of the projector lens or may be a rear side surface thereof.

A specific position of the "at least a portion" constituted as the "up and down direction diverging portion" is not particularly limited at the surface of the projector lens.

The "reference face" signifies a face constituting the surface when the surface of the projector lens is not assumedly provided with a function of diverging light in the up and down direction.

The respective "lens elements" are not particularly limited in a specific vertical sectional shape thereof so far as the respective "lens elements" are extended substantially in the horizontal direction by the vertical sectional shape formed in the recessed and projected shape relative to the reference face of the surface of the projector lens but, for example, a circle arc shape in a recessed shape, a circle arc shape in a projected shape, a waveform shape or the like can be adopted. Specific values of angles of diverging light in the up and down direction by the "respective lens elements" are not particularly limited.

As shown by the above-described constitution, the lamp unit according to the one or more embodiments of the invention is constituted as the projected type lamp unit having the shade, the light distribution pattern having the cutoff line as an inverted projected image of the upper end edge of the shade is formed, at least a portion of the surface of the projector lens is constituted as the up and down diverging portion comprising a plurality of lens elements extended substantially in the horizontal direction by the vertical sectional shape formed in the recessed and projected shape relative to the reference face of the surface. Therefore, the following operation and effect can be achieved.

That is, according to the lamp unit, at least a portion of the surface of the projector lens is constituted as the up and down direction diverging portion, and therefore, with regard to light emitted to the front side by way of the up and down direction diverging portion, the light can be diverged in the up and down direction, thereby, the cutoff line can be shaded off. Thereby, a spectroscopic color appearing at an upper vicinity of the cutoff line owing to a spectroscopic light phenomenon brought about when light from the light source reflected by the cutoff line transmits through the projector lens can be made to be inconspicuous.

The up and down direction diverging portion comprises the plurality of lens elements extended substantially in the horizontal direction by the vertical sectional shape formed in the recessed and projected shape relative to the reference face of the surface of the projector lens. Therefore, a degree of diverging light emitted from the projector lens in the up and down direction can accurately be controlled, thereby, the cutoff line can pertinently be shaded off. Thereby, it can effectively be restrained to bring about a situation in which a brightness of a lower vicinity region of the cutoff line is unpreparedly reduced, or glare is cast to a driver of a vehicle running on an opposed lane by light provided to an upper side of the cutoff line.

Light is diverged substantially in the up and down direction at the up and down direction diverging portion, and therefore, variations can be prevented from being brought about in shading off the cutoff line or an effect of a countermeasure against a spectroscopic color at an upper vicinity thereof by a light emitting position (or a light incident position) in the up and down direction diverging portion.

In this way, in the lamp unit of a vehicle headlamp of a projector type constituted to form the light distribution pattern having the cutoff line, shading off of the cutoff line and the effect of the countermeasure against the spectroscopic color in the upper vicinity can be promoted.

In the above-described constitution, when the vertical sectional shape of the respective lens elements are set to a waveform shape, the respective lens elements can be made to be continuous smoothly, thereby, loss of light at the joint portions of the respective lens elements can be minimized.

In the above-described constitution, although the respective lens elements may be formed to extend straight in the horizontal direction, when the respective lens elements are formed to extend along intersected lines of the surface of the projector lens and planes including horizontal lines orthogonal to the optical axis at a vicinity of the rear side focal point of the projector lens, light of light emitted from the projector lens for forming a portion disposed at the same height in the light distribution pattern can substantially accurately be controlled to diverge in the up and down direction by the single piece of lens element. Thereby, shading off of the cutoff line and the countermeasure against the spectroscopic color at the upper vicinity carried out further without variations.

In the above-described constitution, although specific values of angles of diverging light in the up and down direction by the respective lens elements are not particularly limited as described above, when the more remote is the position of the lens element from the optical axis in the up and down direction, to the larger value the angle is set, light emitted from a region of the projector lens having a large spectroscopic light degree can be diverged considerably in the up and down direction.

Therefore, the countermeasure against the spectroscopic light color at the upper vicinity can effectively be carried out.

In the above-described constitution, when the up and down direction diverging portions are formed at an upper portion region and a lower portion region remote from the optical axis in the up and down direction at the surface of the projector lens, the following operation and effect can be achieved.

That is, the spectroscopic light degree is comparatively small in the center region disposed between the upper portion region and the lower portion region, and therefore, whereas with regard to light irradiated to the front side by way of the center region, the light is effectively utilized for ensuring the brightness at the lower vicinity of the cutoff line without being diverged in the up and down direction, with regard to light irradiated to the front side by way of the upper portion region and the lower portion region increasing the spectroscopic light degree, the light is diverged considerably in the up and down direction to thereby enable to effectively carry out the countermeasure against the spectroscopic light color.

At that occasion, when the plurality of lens elements are formed discretely at predetermined intervals therebetween in the up and down direction at least piece by piece at respective regions of the center region contiguous to respective of the upper portion region and the lower portion region, a region achieving an intermediary optical effect of an optical effect of the upper portion region and the lower portion region formed with the plurality of lens elements and an optical effect of the center region which are not formed with the plurality of lens elements can be ensured. Thereby, ensuring the brightness of the lower vicinity of the cutoff line and shading off of the cutoff line as well as the effect of the countermeasure against the spectroscopic light color at the upper vicinity can be made to be compatible with excellent balance.

Other aspects and advantages of the invention will be apparent from the following description and the appended claims.

DESCRIPTION OF REFERENCE NUMERALS AND SIGNS

Figure 1:
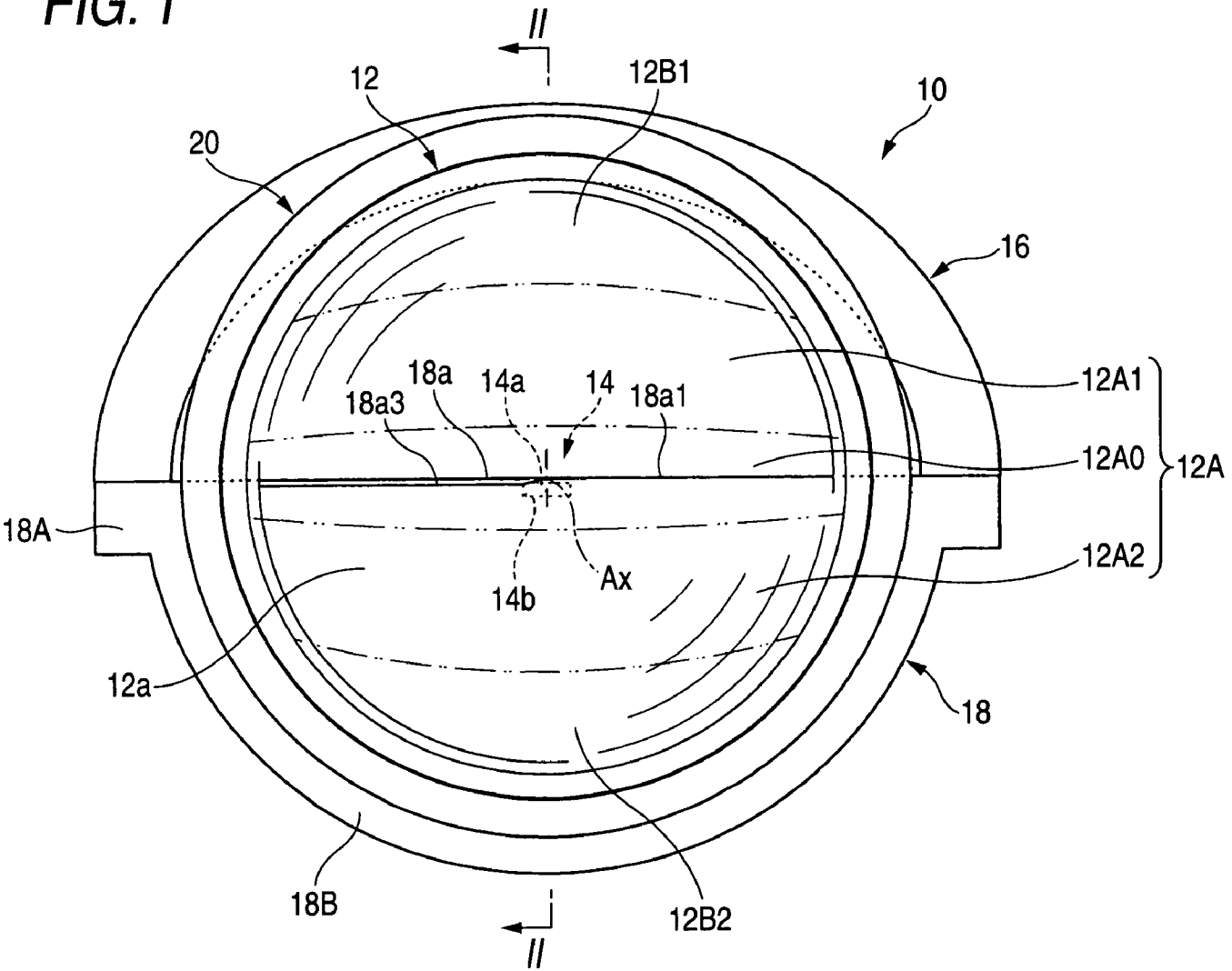
FIG. 1 is a front view showing a lamp unit of a vehicle headlamp according to an embodiment of the invention.

10 lamp unit
12 projector lens
12A center region
12A0 strip-like region
12A1, 12A2 regions
12As, 12Bs lens elements
12B1 upper portion region
12B2 lower portion region
12*a* front side surface
12*a*0 reference face
12*b* rear side surface
14 light emitting element
14*a* light emitting chip
14*b* board
16 reflector
16*a* reflecting face
18 base member
18A flat plate portion
18B semicylindrical portion
18*a* upper face
18*a*1 front end edge
18*a*2 recessed groove portion
18*a*3 stepped down flat face portion
20 lens holder
Ax optical axis
CL1 opposed vehicle lane side cutoff line
CL2 driving vehicle lane side cutoff line
D, D1, D2, D3 dim light portions
E elbow point
F rear side focal point
HZ hot zone
PA light distribution pattern
PB diverged light distribution pattern
PL light distribution pattern for low beam

DETAILED DESCRIPTION OF THE EXEMPLARY EMBODIMENTS

An exemplary embodiment of the invention will be explained in reference to the drawings as follows.

FIG. 1 is a front view showing a lamp unit 10 of a vehicle headlamp according to an exemplary embodiment of the invention.

Figure 2:
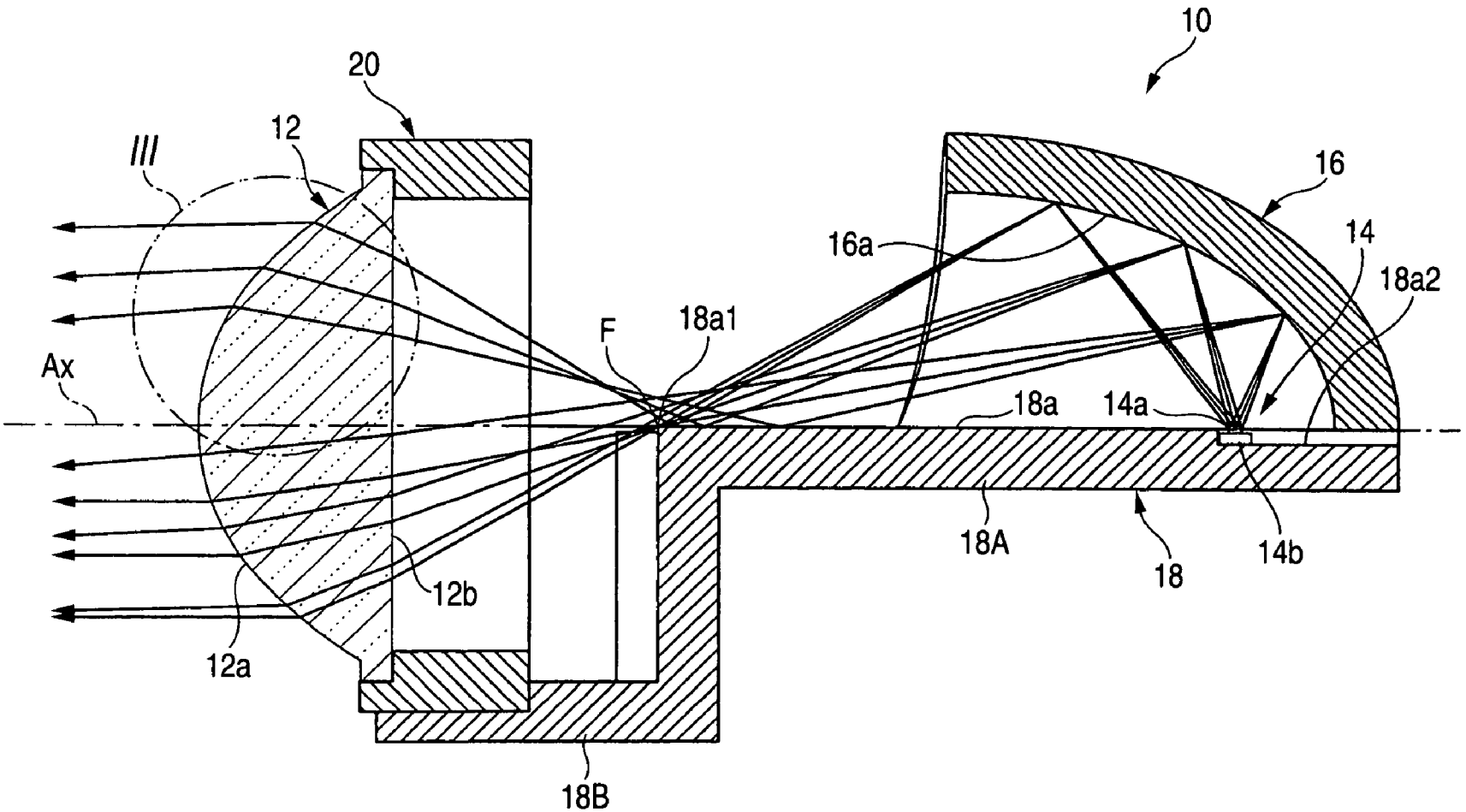
FIG. 2 is a sectional view taken along a line II-II of FIG. 1.

FIG. 2 is sectional view taken along a line II-II of FIG. 1.

As shown by the drawings, the lamp unit 10 is constituted as a lamp unit of a projector type for irradiating light for forming a portion of a light distribution pattern for low beam.

The lamp unit 10 is used in a state of being integrated to a lamp body or the like, not illustrated, to be able to adjust an optical axis thereof. The lamp unit 10 is arranged in a state in which an optical axis Ax is extended in a lower direction relative to a front and rear direction of a vehicle by about 0.5 through 0.6°.

The lamp unit 10 is provided with a projector lens 12, a light emitting element 14, a reflector 16, a base member 18, and a lens holder 20.

The base member 18 is a metal made member and comprises a flat plate portion 18A including an upper face 18*a* extended along a horizontal face including the optical axis Ax of the lamp unit 10, and a semicylindrical portion 18B formed to bulge to a lower side substantially in a semicylindrical shape at a front end portion of the flat plate portion 18A.

The projector lens 12 is a flat concave aspherical lens made of acrylic resin a front side surface 12*a* of which is constituted by a concave face and a rear side surface 12*b* is constituted by a flat face. The projector lens 12 projects an image on a rear side focal face including a rear side focal point F thereof onto a vertical imaginary screen arranged on a front side of the lamp unit. However, a portion of the front side surface 12*a* of the projector lens 12 is constituted as an up and down direction diverging portion. The point will be described later.

The projector lens 12 is fixedly supported by a front end ring-like groove portion of the lens holder 20 in a cylindrical shape at a peripheral edge portion thereof. The lens holder 20 is fixedly supported by the semicylindrical portion 18B of the base member 18 at a lower half portion thereof.

The light emitting element 14 is a white light emitting diode and provided with a light emitting chip 14*a* having a light emitting face of a square shape of about 1 mm square, and a board 14*b* supporting the light emitting chip 14*a*. The light emitting chip 14*a* is sealed by a thin film formed to cover the light emitting face.

The light emitting element 14 is fixedly supported by the flat plate portion 18A of the base member 18 on a rear side of the rear side focal point F of the projector lens 12.

The light emitting element 14 is positioned at inside of a recessed groove portion 18*a*2 formed at a rear portion of the upper face 18*a* of the flat plate portion 18A at the board 14*b* in a state of arranging the light emitting chip 14*a* to be directed in a vertical upper direction on the optical axis Ax.

The reflector 16 is formed in a shape of a half dome to cover the light emitting element 14 from an upper side and is fixedly mounted to the upper face 18*a* of the flat plate portion 18A of the base member 18 at a lower end face of a peripheral edge thereof. The reflector 16 reflects light emitted from the light emitting chip 14*a* of the light emitting element 14 to the projector lens 12 to be proximate to the optical axis Ax.

Specifically, a reflecting face 16*a* of the reflector 16 is set to an elliptical shape in a sectional shape along a plane including the optical axis Ax. At that occasion, according to the reflecting face 16*a*, a sectional shape along a vertical face including the optical axis Ax is set to an elliptical shape constituting a first focal point by a light emitting center of the light emitting chip 14*a* and constituting a second focal point by the rear side focal point F of the projector lens 12, an eccentricity is set to gradually increase while making the first focal point constant from a vertical face including the optical axis Ax to a horizontal face including the optical axis Ax. Thereby, the reflecting face 16*a* converges light emitted from the light emitting chip 14*a* to the rear side focal point F of the projector lens 12 in the vertical face and converges the light onto the optical axis Ax on a front side of the rear side focal point F to some degree in the horizontal section.

According to the flat plate portion 18A of the base member 18, a front end edge 18*a*1 of the upper face 18*a* is formed to extend substantially in a circular arc shape in a horizontal direction along the rear side focal face (that is, a curved face substantially in a spherical shape formed by the rear side focal point F and a rear side focal point outside of the axis) of the projector lens 12. At that occasion, a portion of a left side (right side in a front view of the lamp piece) of the optical axis Ax of the front end edge 18*a*1 is formed to extend horizontally in a left direction from the optical axis Ax, on the other hand, a portion on a right side of the optical axis Ax is formed to extend in a skewed lower direction (for example, lower direction by 15°) in a right direction from the optical axis Ax and thereafter extended horizontally in the right direction. The portion on the right side of the optical axis Ax of the upper face 18*a* of the flat plate portion 18A is constituted as a stepped down flat plate portion 18*a*3 extended horizontally in a rear direction over a predetermined length while staying to be in the shape of the front end edge 18*a*1.

The flat plate portion 18A of the base member 18 functions as a shade for hampering emittance of light in an upper direction from the projector lens 12 by hampering a portion of light reflected from the reflector 16 from advancing straight.

At that occasion, according to the flat plate portion 18A, the upper face 18 functions as a mirror member constituted as an upper directed mirror face for regularly reflecting light reflected from the reflector 16 in an upper direction. In order to realize the function, the upper face 18*a* of the flat plate portion 18A is subjected to a mirror face treatment of vapor-depositing aluminum or the like. Further, it is not necessarily needed to carry out the mirror face treatment over an entire region of the upper face 18*a* of the flat plate portion 18A but it is sufficient when the treatment is carried out over a range from the upper end edge 18*a*1 to a rear side to some degree.

Figure 3:
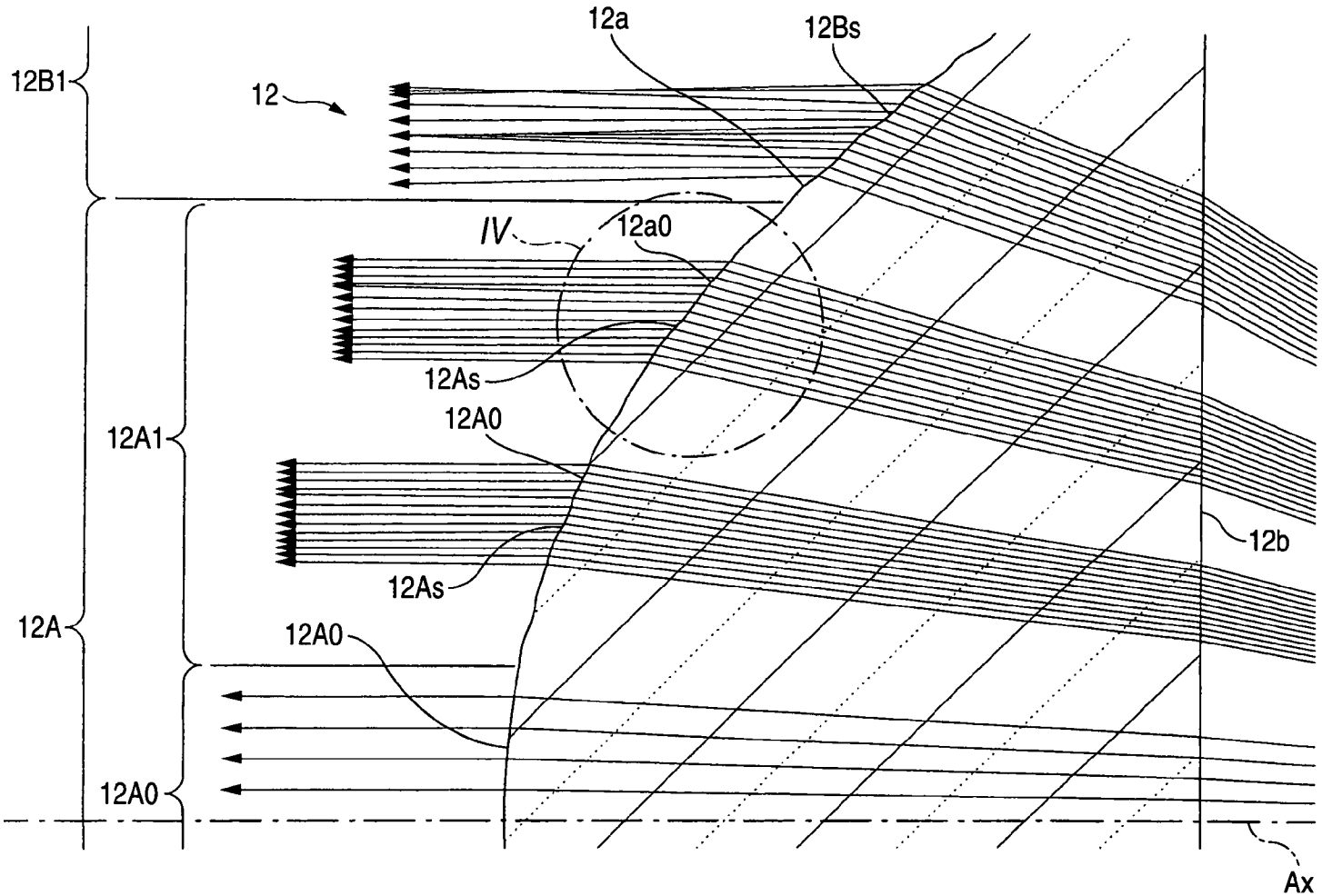
FIG. 3 is a detailed view of III portion of FIG. 2.
Figure 4:
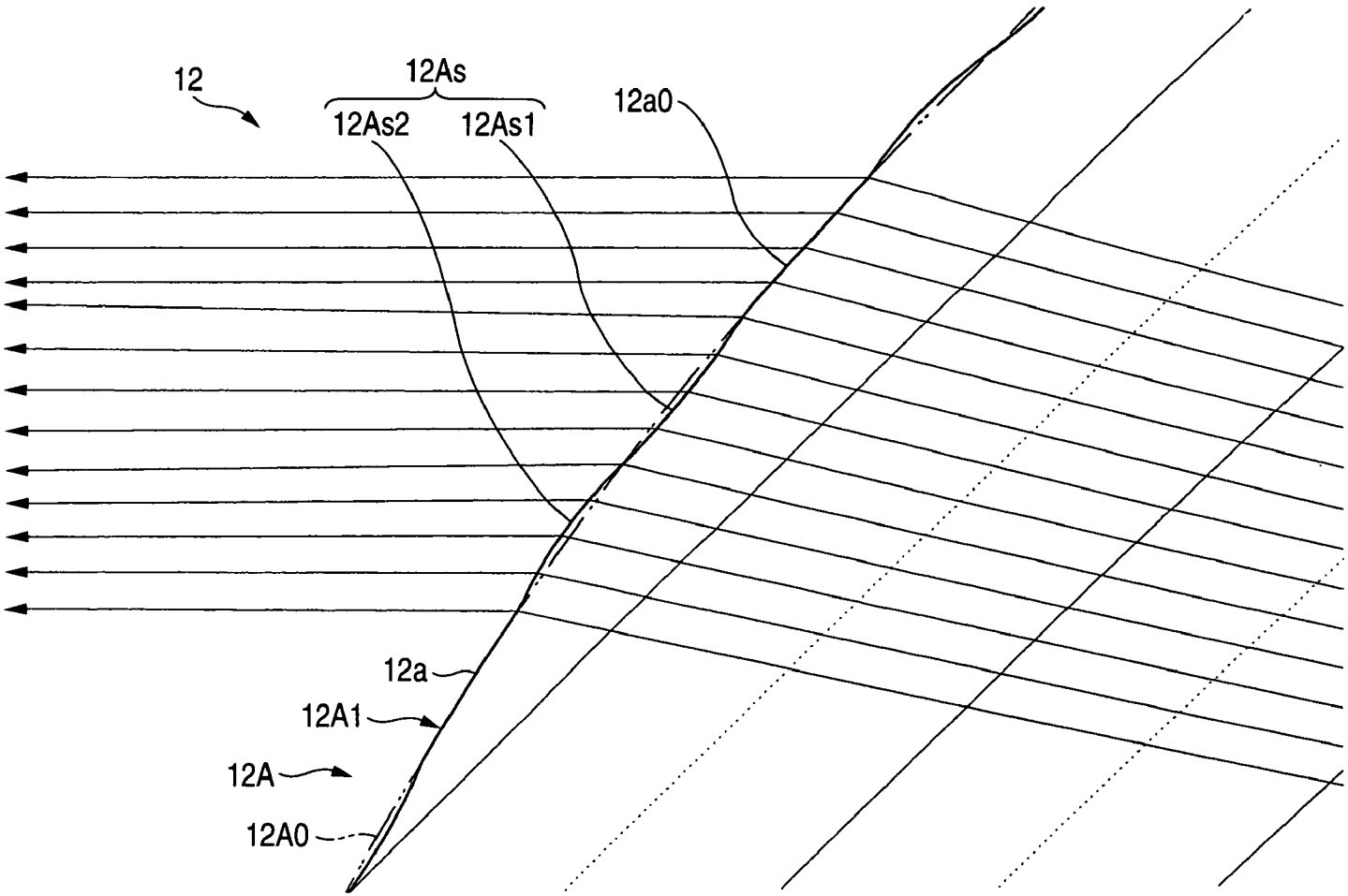
FIG. 4 is a detailed view of IV portion of FIG. 3.
Figure 5:
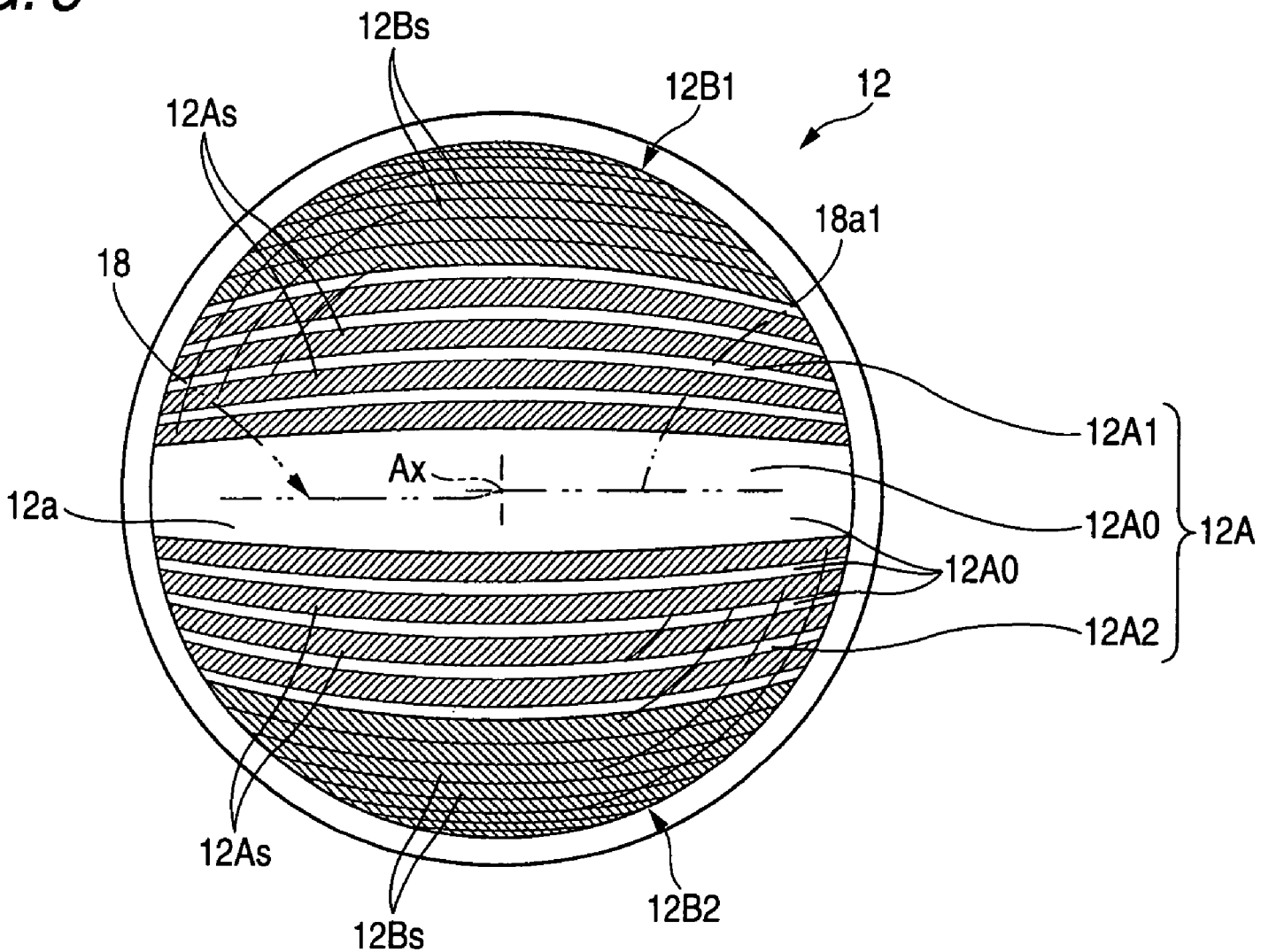
FIG. 5 is a front view showing a single piece of a projector lens of the lamp unit.

FIG. 3 is a detailed view of III portion of FIG. 2, FIG. 4 is a detailed view of IV portion of FIG. 3. FIG. 5 is a front view showing a single piece of the projector lens 12.

In FIG. 3 and FIG. 4, in order to explain an optical function of the projector lens 12 to be easy to understand, there is shown an optical path of light incident on the projector lens 12 from an imaginary point light source arranged at the rear side focal point F.

As shown by the drawings, an upper portion region 12B1 and a lower portion region 12B2 remote from the optical axis Ax in the up and down direction at the front side surface 12*a* of the projector lens 12 are constituted as up and down direction diverging portions for diverging light emitted from the projector lens 12 in the up and down direction.

In order to realize the constitution, the upper portion region 12B1 and the lower portion region 12B2 are constituted by a plurality of lens elements 12Bs extended substantially in the horizontal direction by a vertical sectional shape thereof formed in a recessed and projected shape respectively relative to a reference shape 12*a*0 of the front side surface 12*a*. At that occasion, the respective lens elements 12Bs constituting respective of the upper portion region 12B1 and the lower portion region 12B2 are set to a waveform shape in the vertical sectional shapes thereof, all of angles thereof of diverging light in the up and down direction are set to the same value.

On the other hand, according to a center region 12A disposed between the upper portion region 12B1 and the lower portion region 12B2 in the front side surface 12*a* of the projector lens 12, a transversely-prolonged strip-like region 12A0 disposed at an upper and lower vicinities of the optical axis Ax is constituted by a surface shape of staying to be that of the reference face 12*a*0 of the front side surface 12A, portions of respective regions 12A1, 12A2 respectively contiguous to the upper portion region 12B1 and the lower portion region 12B2 are constituted as up and down direction diverging portions for diverging light emitted from the projector lens 12 in the up and down direction.

That is, the respective regions 12A1, 12A2 are formed with pluralities of lens elements 12As discretely piece by piece at predetermined intervals therebetween in the up and down direction. At that occasion, also the respective lens elements 12As constituting the respective regions 12A1, 12A2 are set to a waveform shape in a vertical sectional shape thereof similar to the respective lens elements 12Bs. However, according to the respective lens elements 12As, angles thereof of diverging light in the up and down-direction is set to a value smaller than that of the respective lens elements 12Bs.

Among the respective lens elements 12As, in the respective regions 12A1, 12A2, the more remote is the position of the lens element from the optical axis Ax in the up and down direction, to the more large value the angle of diverging light in the up and down direction is set.

The angles of diverging light in the up and down direction of the respective lens elements 12As, 12Bs are set by adjusting sizes of radii of curvature of a recessed portion and a projected portion constituting the optical sectional shape of the waveform.

The respective lens elements 12As, 12Bs are formed to extend along intersecting lines of the front side surface 12*a* of the projector lens 12 and planes including horizontal lines orthogonal to the optical axis Ax at a vicinity of the rear side focal point F of the projector lens 12. Therefore, in a front view of the lamp unit, the respective lens elements 12As, 12Bs are extended along substantially a circle arc shape concave to the upper side at the upper portion region 12B1 and the region 12A1 contiguous thereto disposed on the upper side of the optical axis Ax, on the other hand, extended substantially in a circle arc shape concave to the lower side at the lower region 12B2 and the region 12A2 contiguous thereto disposed on the lower side of the optical axis Ax.

As shown by FIG. 4, the region 12A1 of the center region 12A contiguous to the upper portion region 12B1 constitutes one unit by the reference face 12*a*0 in the strip-like shape disposed between the respective lens elements 12As as well as a recessed portion 12As1 and a projected portion 12As2 in a strip-like shape constituting each of the lens elements 12As and is formed in a transverse stripe shape by repeating the units. At that occasion, the reference face 12*a*0, the recessed portion 12As1 and the projected portion 12As2 in the strip-like shape are formed by up and down widths substantially the same as each other. Further, the same goes with the region 12A2 of the center region 12A contiguous to the lower portion region 12B2.

Figure 6:
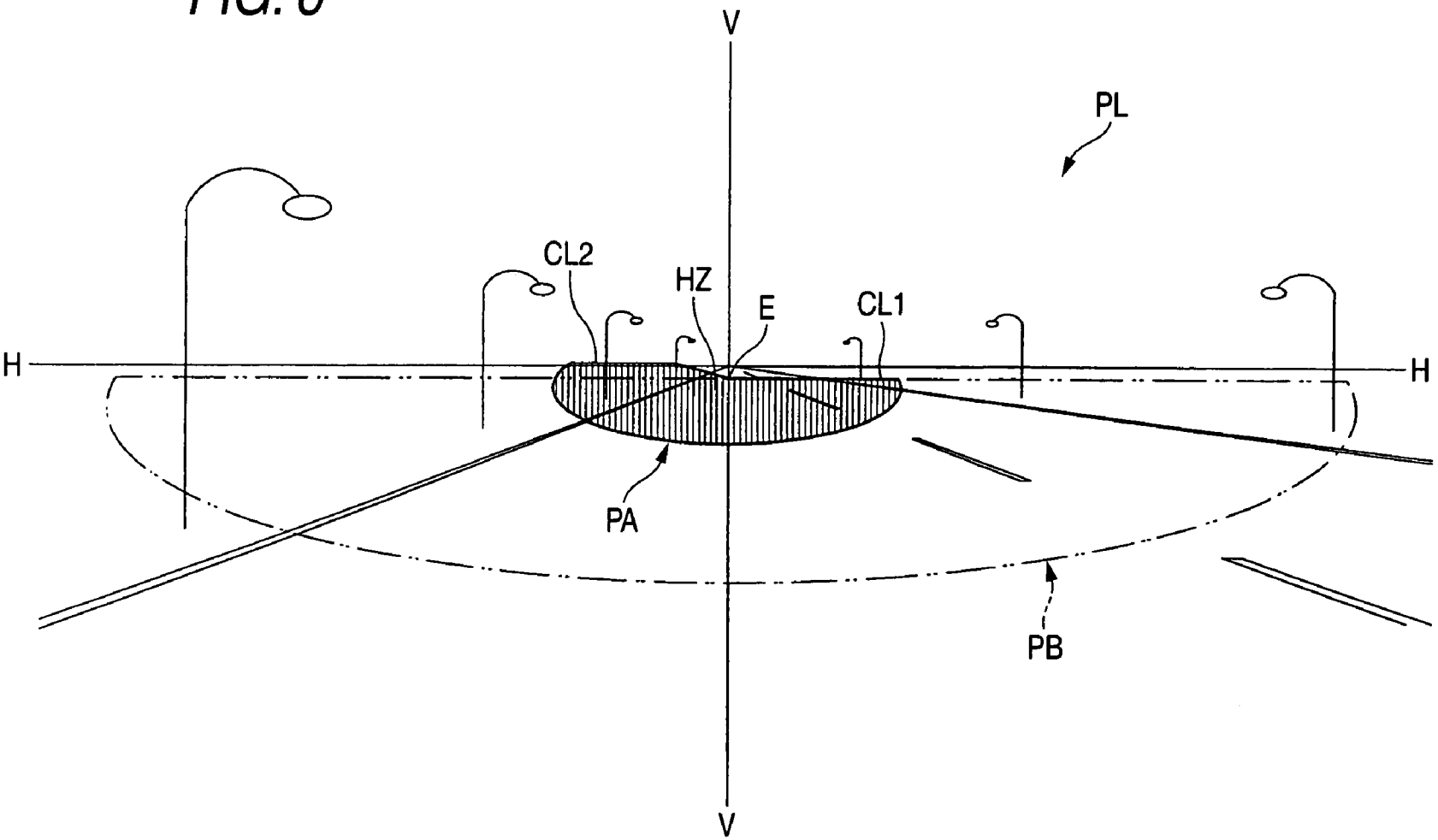
FIG. 6 is a diagram perspectively showing a light distribution pattern formed on an imaginary vertical screen arranged at a position 25 m frontward from the lamp unit by light irradiated from the lamp unit to a front side.

FIG. 6 is a diagram perspectively showing a light distribution pattern PA formed on an imaginary vertical screen arranged at a position 25 m frontward from the lamp unit by light irradiated from the lamp unit 10 according to the embodiment to the front side.

As shown by the drawing, the light distribution pattern PA is a transversely-prolonged comparatively small light distribution pattern for converging light having cutoff lines CL1, CL2 at an upper end portion thereof, and is formed as a portion of a light distribution pattern PL for low beam. That is, the light distribution pattern PL for low beam is formed as a light distribution pattern synthesized with the light distribution pattern PA and a diverged light distribution pattern PB formed by light irradiated from other lamp unit, not illustrated, to the front side, a hot zone HZ constituting a high luminous intensity region thereof is formed by the light distribution pattern PA.

The light distribution pattern PA is formed by light from the light emitting chip 14*a* emitted to the front side after having been reflected by the reflecting face 16*a* of the reflector 16 and transmitted through the projector lens 12, the cutoff lines CL1, CL2 are formed as an inverted projected image of the front end edge 18*a*1 of the upper face 18*a* of the flat plate portion 18A of the base member 18. According to the cutoff lines CL1, CL2, the opposed vehicle lane side cutoff line CL1 on a right side of V-V line constituting a vertical line passing H-V constituting a vanishing point in a direction of a front face of the lamp piece is formed to extend horizontally, and the driving vehicle lane side cutoff line CL2 on a left side of V-V line is formed to rise skewedly to substantially an upper side of H-H line constituting a horizontal line passing H-V from the opposed vehicle lane side cutoff line CL1 by a predetermined angle (for example, 15°) and thereafter extend horizontally.

In the light distribution pattern PA, a position of elbow point E constituting an intersecting point of the opposed vehicle lane side cutoff line CL1 and V-V line is set to a position downward from H-V by about 0.5 through 0.6°. This is because the optical axis Ax of the lamp unit 10 is extended in a lower direction relative to the axis line extended in the front and rear direction of the vehicle by about 0.5 through 0.6°.

Not only light directly incident on the projector lens 12 after having been reflected by the reflecting face 16*a* of the reflector 16 but also light incident on the projector lens 12 by being regularly reflected in an upper direction by the upper face 18*a* of the flat plate portion 18A of the base member 18 after having been reflected by the reflecting face 16*a* of the reflector 16 are used for forming the light distribution pattern PA. Therefore, the light distribution pattern PA constitutes a light distribution pattern intensifying a brightness thereof by that amount.

Figure 7:
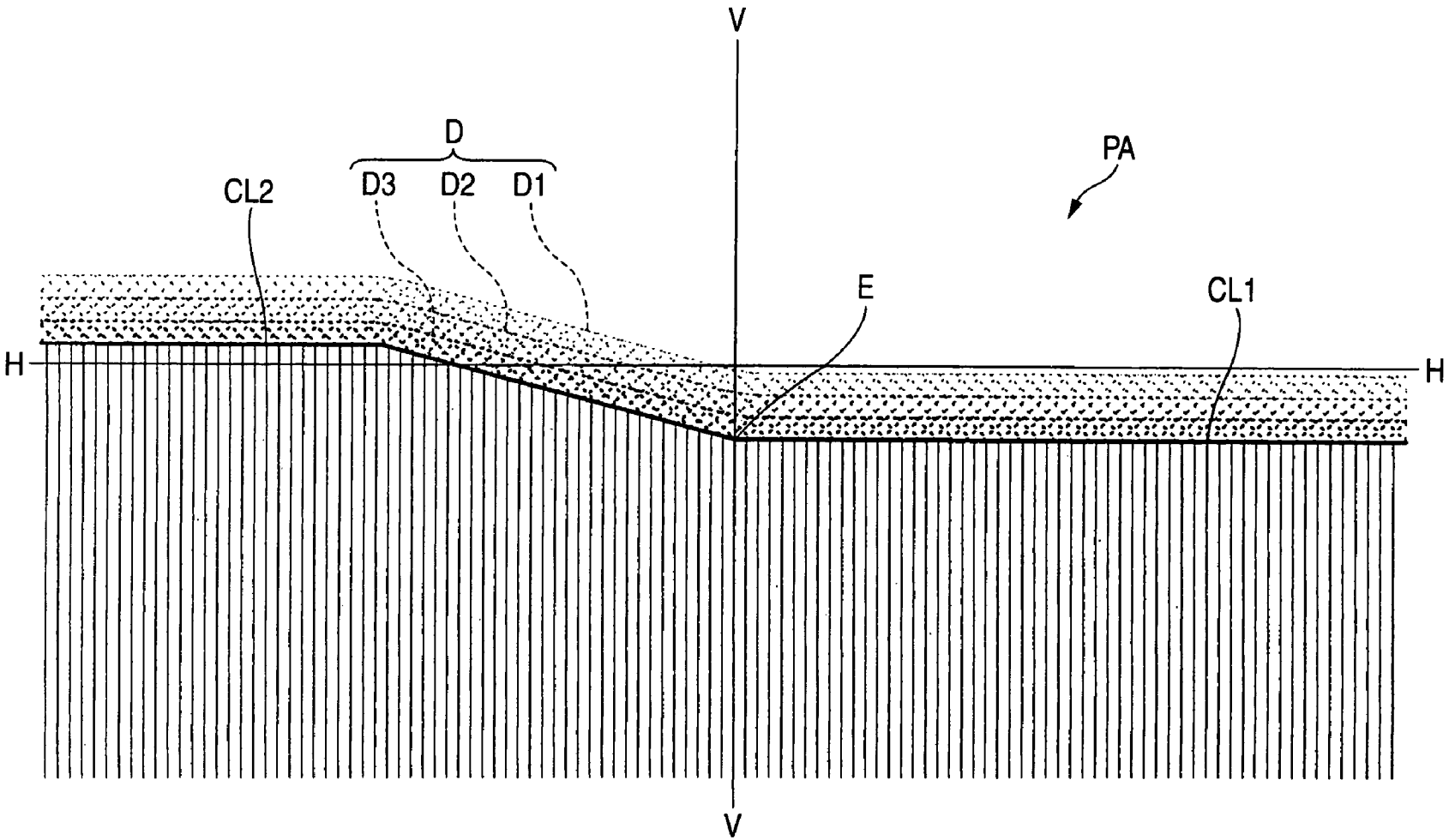
FIG. 7 is a diagram enlarging to show a region at a vicinity of an elbow point of the light distribution pattern.

FIG. 7 is a diagram enlarging to show a region at a vicinity of elbow point E of the light distribution pattern PA.

As shown by the drawing, according to the light distribution pattern PA, the cutoff lines CL1, CL2 are pertinently shaded off.

That is, upper vicinities of the cutoff lines CL1, CL2 of the light distribution pattern PA are formed with a dim light portion D extended in a strip-like shape substantially by constant width along the cutoff lines CL1, CL2. At that occasion, the dim light portion D is formed to become gradually dark in an order of dim light portions D3, D2, D1.

The darkest dim light portion D1 is formed by an up and down width of about 0.5° along the cutoff lines CL1, CL2. The dim light portion D1 is formed by light emitted from the upper portion region 12B1 and the lower portion region 12B2 of the front side surface 12*a* of the projector lens 12.

At that occasion, the dim light portion D1 is formed by the up and down width of about 0.5° because in the respective lens elements 12Bs formed at the upper region portion 12B1 and the lower portion region 12B2, radii of curvature of the recessed portion and the projected portion forming the vertical sectional shape of the waveform are set to values for diverging light emitted from the projector lens 12 in the up and down direction by about 0.5°.

The dim light portion D1 is formed by substantially the constant width because the respective lens elements 12Bs are extended substantially in the horizontal direction. At that occasion, the respective lens elements 12Bs are formed to extend along the intersected lines of the front side surface 12*a* of the projector lens 12 and the planes including the horizontal lines orthogonal to the optical axis Ax at vicinities of the rear side focal point F. Therefore, the dim light portion D1 is formed substantially by the constant width not only at the vicinity of the elbow point E but also over total lengths of the cutoff line CL1, CL2.

The dim light portion D2 slightly brighter than the dim light portion D1 is formed by an up and down width slightly narrower than that of the dim light portion D1 along the cutoff lines CL1 CL2, the dim light portion D3 slightly brighter than the dim light portion D2 is formed by an up and down width further narrower than the dim light portion D2 along the cutoff line CL1, CL2. The dim light portions D2, D3 are formed by light emitted from the respective regions 12A1, 12A2 of the center region 12A of the front side surface 12*a* of the projector lens 12.

At that occasion, the dim light portions D2, D3 are formed by the up and down widths narrower than that of the dim light portion D1 because in the respective lens elements 12As formed at the respective regions 12A1, 12A2, radii of curvature of the recessed portion and the projected portion forming the vertical sectional shape of the waveform are set to values smaller than those of the case of the respective lens elements 12Bs. The brightnesses of the dim light portions D2, D3 are changed in steps because among the respective lens elements 12As, the remoter the position of the lens element in the up and down direction from the optical axis Ax, to the larger value the radii of curvature of the recessed portion and the projected portion forming the vertical sectional shape of the waveform of the lens element 12As are set.

The dim light portions D2, D3 are respectively formed substantially by the constant widths because the respective elements 12As are extended substantially in the horizontal direction. At that occasion, since the respective lens elements 12As are formed to extend along the intersected lines, the dim light portions D2, D3 are respectively formed substantially by the constant widths not only at vicinities of the elbow point E but also over the total lengths of the cutoff lines CL1, CL2.

As has been described above in details, in the vehicle headlamp 10 according to the embodiment, the lamp unit 10 is constituted by the lamp unit of the projector type constituting the light source by the light emitting chip 14*a* of the light emitting element 14, the upper portion region 12B1 and the lower portion region 12B2 of the front side surface 12*a* of the projector lens 12 are constituted as the up and down direction diverging portions comprising the plurality of lens elements 12Bs extended substantially in the horizontal direction by the vertical sectional shape formed in the recessed and projected shape relative to the reference face 12*a*0 of the front side surface 12*a*. Therefore, with regard to light emitted to the front side from the upper portion region 12B1 and the lower portion region 12B2, the light can be diverged in the up and down direction, thereby, the cutoff lines CL1, CL2 can be shaded off. Thereby, spectroscopic color which appears owing to the spectroscopic phenomenon brought about when light from the light emitting element 14 reflected by the reflector 16 transmits through the projector lens 12 can be made to be inconspicuous at the upper vicinities of the cutoff lines CL1, CL2.

At that occasion, the upper portion region 12B1 and the lower portion region 12B2 constituting the up and down direction diverging portions comprise the plurality of lens elements 12Bs extended substantially in the horizontal direction by the vertical sectional shape formed in the recessed and projected shape relative to the reference face 12*a*0 of the upper side surface 12*a* of the projector lens 12. Therefore, a degree of diverging light emitted from the projector lens 12 in the up and down direction can accurately be controlled, thereby, the cutoff lines CL1, CL2 can pertinently be shaded off. Thereby, it can effectively be restrained to bring about a situation in which a brightness of lower vicinity regions of the cutoff lines CL1, CL2 is unpreparedly reduced, or glare is cast to a driver of an opposed vehicle by light diverged to upper sides of the cutoff lines CL1, CL2.

Since light is diverged substantially in the up and down direction at the upper portion region 12B1 and the lower portion region 12B2, variations can be prevented from being brought about in shading off the cutoff lines CL1, CL2 by the positions of emitting light in the upper portion region 12B1 and the lower portion region 12B2 and in the effect of the countermeasure against the spectroscopic color at the upper vicinities thereof.

In this way, according to the embodiment, in the lamp unit 10 of the vehicular lamp piece of the projector type constituted to form the light distribution pattern PA including the cutoff lines CL1, CL2, the shading off the cutoff line CL1, CL2 and the effect of the countermeasure against the spectroscopic color at the upper vicinities thereof can be promoted.

According to the embodiment, the vertical sectional shapes of the respective lens elements 12Bs are set to the waveform shape, and therefore, the respective elements 12Bs can be made to be continuous to each other smoothly, thereby, loss of light at portions of jointing the respective lens elements 12Bs can be minimized.

According to the embodiment, the respective lens elements 12Bs are formed to extend along the intersected lines of the front side surface 12*a* of the projector lens 12 and the planes including the horizontal lines orthogonal to the optical axis Ax at vicinities of the rear side focal point F, and therefore, light of light emitted from the projector lens 12 for forming a portion of the light distribution pattern PA disposed at the same height can be controlled to diverge substantially accurately in the up and down direction by the single lens element 12Bs, thereby, the shading off of the cutoff lines CL1, CL2 and the countermeasure against the spectroscopic color at upper vicinities thereof can further be carried out without variations.

According to the embodiment, the upper portion region 12B1 and the lower portion region 12B2 remote from the optical axis Ax at the front side surface 12*a* of the projector lens 12 are constituted as the up and down direction diverging portions, and therefore, the following operation and effect can be achieved.

That is, the degree of the spectroscopic light is comparatively small at the center region 12A disposed between the upper portion region 12B1 and the lower portion region 12B2, and therefore, with regard to light irradiated to a front side by way of the center region 12A, the light is effectively utilized for ensuring a brightness at a lower vicinity of the cutoff lines CL1, CL2 without being diverged in the up and down direction, with regard to light irradiated to the front side by way of the upper portion region 12D1 and the lower portion region 12B2 increasing the degree of the spectroscopic light, the light is diverged considerably in the up and down direction to thereby enable to carry out the countermeasure against the spectroscopic light effectively.

At that occasion, according to the embodiment, the plurality of lens elements 12As are discretely formed at predetermined intervals therebetween in the up and down direction piece by piece at the respective regions 12A1, 12A2 respectively contiguous to the upper portion region 12B1 and the lower portion region 12B2 in the center region 12A. Therefore, a region achieving an intermediary optical effect of an optical effect of the upper portion region 12B1 and the lower portion 12B2 formed with the plurality of lens elements 12Bs and an optical effect of the center region 12A which are not formed with the respective regions 12A1, 12A2 can be ensured. Thereby, ensuring a brightness at a lower vicinity of the cutoff lines CL1, CL2 and shading off of the cutoff lines CL1, CL2 as well as the effect of the countermeasure against the spectroscopic color at an upper vicinity thereof can be made to be compatible with each other with excellent balance. That is, the brightness at the lower vicinity of the cutoff lines CL1, CL2 can be ensured by light emitted from the reference faces 12*a*0 in the strip-like shape disposed between the respective lens elements 12As, and the shading off of the cutoff lines CL1, CL2 as well as the effect of the countermeasure against the spectroscopic color at the upper vicinity can be achieved by light emitted from the respective lens elements 12As.

According to the embodiment, the more remote is the position of the lens element 12Bs from the optical axis Ax in the up and down direction more than the lens element 12As, to the larger value the light diverging angle in the up and down direction is set. Therefore, light emitted from the upper portion region 12B1 and the lower portion region 12B2 increasing the degree of the spectroscopic light in the projector lens 12 can be diverged considerably in the up and down direction. Thereby, the countermeasure against the spectroscopic color at the upper vicinity can effectively by carried out while preventing the shading off of the cutoff lines CL1, CL2 from being excessive thereby.

According to the embodiment, the more remote the position of the lens element from the optical axis Ax in the up and down direction, to the larger value the light diverging angle in the up and down direction is set even among the plurality of lens elements 12As formed at the respective regions 12A1, 12A2 of the center region 12A. Therefore, the shading of the cutoff lines CL1, CL2 can be carried out in steps, also the effect of the countermeasure against the spectroscopic color at the upper vicinity of the cutoff lines CL1, CL2 can further be promoted.

Although according to the embodiment, an explanation has been given such that with regard to the respective lens elements 12Bs constituting respectives of the upper portion region 12B1 and the lower portion region 12B2, all of the light diverging angles in the up and down direction are set to the same value, the light diverging angles can also be set to values different from each other. Thereby, the shading off of the cutoff lines CL1, CL2 and the effect of the countermeasure against the spectroscopic color at the upper vicinity can further be promoted.

Although according to the embodiment, an explanation has been given such that the plurality of lens elements 12As are discretely formed at the respective regions 12A1, 12A2 of the center region 12A at predetermined intervals therebetween in the up and down direction piece by piece, even when there is constructed a constitution of discretely forming pluralities of pieces of the plurality of lens elements 12As at predetermined intervals therebetween in the up and down direction, operation and effect substantially similar to those of the embodiment can be achieved.

Meanwhile, although in the lamp unit 10 according to the embodiment, the light source is constituted by the light emitting chip 14*a* of the light emitting element 14, even when the light source is constituted by a light emitting portion of a discharge bulb or a halogen bulb, operation and effect similar to those of the embodiment can be achieved.

Although according to the embodiment, an explanation has been given of a case in which the light distribution pattern PA formed by light irradiated from the lamp unit 10 is the light distribution pattern for converging light constituting a portion of the light distribution pattern PL for low beam, even when the light distribution pattern PA is a diverging light distribution pattern, operation and effect similar those of the embodiment can be achieved.

Although in the lamp piece 10 according to the embodiment, the base member 18 having the function as the mirror member achieves the function as the shade for shielding a portion of light reflected from the reflector 16, in place of the base member 18, there can be constructed a constitution of including an ordinary shade having only the function of shielding a portion of light reflected from the reflector 16.

Numerical values shown as data in the embodiment are only examples and the numerical values may naturally be set to pertinent different values.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A lamp unit of a vehicle headlamp comprising:

a projector lens arranged on an optical axis extended in a front and rear direction of a vehicle;

a light source arranged on a rear side of a rear side focal point of the projector lens;

a reflector that reflects light from the light source in a front direction to be proximate to the optical axis; and a shade that shields a portion of light reflected from the reflector, wherein at least a portion of a surface of the projector lens is constituted as an up and down direction diverging portion including a plurality of lens elements extended substantially in a horizontal direction by a vertical sectional shape formed in a recessed and projected shape relative to a reference face of the surface, wherein an upper end edge of the shade is provided at a position of the rear side focal point of the projector lens, and the lamp unit forms a light distribution pattern having a cutoff line as an inverted projected image of the upper end edge of the shade, wherein the lens elements are structured to form a plurality of dim light portions on an upper vicinity of the cutoff line, wherein the dim light portions are reduced in luminescence relative to the rest of the light distribution pattern.

2. The lamp unit according to claim 1, wherein the vertical sectional shape of the respective lens elements have waveform shapes.

3. The lamp unit according to claim 1, wherein the respective lens elements are formed to extend along intersected lines of the surface of the projector lens and planes including horizontal lines orthogonal to the optical axis at a vicinity of the rear side focal point of the projector lens.

4. The lamp unit according to claim 1, wherein the more remote the position of each lens element from the optical axis in the up and down direction, the larger the value the angle of diverging light in the up and down direction by each of the lens elements is set.

5. The lamp unit according to claim 1, wherein the up and down direction diverging portions are formed at an upper portion region and a lower portion region remote from the optical axis in the up and down direction at the surface of the projector lens.

6. The lamp unit according to claim 5, wherein a plurality of the lens elements are formed discretely at predetermined intervals in the up and down direction in a center region disposed between the upper portion region and the lower portion region, said plurality of the lens elements being formed contiguous to respective lens elements of the upper portion region and the lower portion region.

7. The lamp unit according to claim 1, wherein a cutoff line of a light distribution pattern is formed by an upper end edge of the shade, a plurality of dim light portions are formed on an upper vicinity of the cutoff line, and each of the dim light portions is extended in a strip-like shape substantially by constant width along the cutoff line, and the dim light portions are formed to become gradually dark as the positions of the dim light portions are remote from the cutoff line.

8. The lamp unit according to claim 1, wherein a rear surface of the lens includes a flat face, and the up and down direction diverging portion is provided on a front surface of the lens.

9. The lamp unit according to claim 1, wherein the up and down direction diverging portion comprises an upper region and a lower region, and wherein a center region having a surface shape serving as the reference face is provided between the upper region and lower region.

10. A lamp unit of a vehicle headlamp comprising:

a projector lens arranged on an optical axis extended in a front and rear direction of a vehicle;

a light source arranged on a rear side of a rear side focal point of the projector lens;

a reflector that reflects light from the light source in a front direction to be proximate to the optical axis; and a shade that shields a portion of light reflected from the reflector, wherein at least a portion of a surface of the projector lens is constituted as an up and down direction diverging portion including a plurality of lens elements extended substantially in a horizontal direction by a vertical sectional shape formed in a recessed and projected shape relative to a reference face of the surface, wherein the up and down direction diverging portion comprises an upper region and a lower region, and wherein a center region having a surface shape serving as the reference face is provided between the upper region and lower region, wherein the upper region comprises a first upper section and a second upper section, wherein the recessed and projected shape of the first upper section is smaller than the recessed and projected shape of the second upper section, wherein the lower region comprises a first lower section and a second lower section, wherein the recessed and projected shape of the first lower section is smaller than the recessed and projected shape of the second lower section, and the first upper section and first lower section are provided next to the center region.

11. The lamp unit according to claim 1, wherein each lens element extends substantially across the width of the projector lens.

* * * * *